US006308945B1

(12) United States Patent
Sägesser

(10) Patent No.: US 6,308,945 B1
(45) Date of Patent: Oct. 30, 2001

(54) APPARATUS FOR PLACING FOLDED SIGNATURES ON A TRANSPORT DEVICE

(75) Inventor: Christoph Sägesser, Mägenwil (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/396,503

(22) Filed: Sep. 10, 1999

(30) Foreign Application Priority Data

Sep. 28, 1998 (EP) ..... 98810972

(51) Int. Cl.[7] ..... B65H 5/30

(52) U.S. Cl. ..... 270/52.27; 270/52.29; 493/409; 493/465; 493/471

(58) Field of Search ..... 270/52.27, 52.28, 270/52.29; 493/409, 465, 471

(56) References Cited

U.S. PATENT DOCUMENTS

| | | | | |
|---|---|---|---|---|
| 2,413,358 | * | 12/1946 | Kleineberg | 270/52.29 |
| 3,199,862 | * | 8/1965 | Muller | 270/52.27 |
| 3,809,384 | * | 5/1974 | Zugel | 270/52.28 |
| 4,180,255 | * | 12/1979 | Himmel | 270/52.27 |
| 4,299,378 | * | 11/1981 | Muller | 270/52.27 |
| 4,358,100 | | 11/1982 | M üller . | |
| 4,491,311 | * | 1/1985 | Glanzmann | 270/52.27 |
| 4,706,950 | * | 11/1987 | Ruetschle et al. | 270/52.28 |
| 4,875,669 | | 10/1989 | McCain et al. . | |
| 5,893,824 | * | 4/1999 | Schlough | 493/409 |

FOREIGN PATENT DOCUMENTS

| | | | |
|---|---|---|---|
| 408 065 | | 9/1966 | (CH) . |
| 4 269 594 | | 9/1992 | (CN) . |
| 2 228 230 | | 2/1973 | (DE) . |
| 3926607A1 | * | 8/1988 | (DE) . |
| 3910499A1 | * | 4/1989 | (DE) . |
| 0718225A2 | * | 12/1994 | (EP) . |

* cited by examiner

*Primary Examiner*—Joseph E. Valenza
*Assistant Examiner*—Patrick Mackey
(74) *Attorney, Agent, or Firm*—Darby & Darby

(57) ABSTRACT

Signatures (1) are individually gripped from a stack (2) by a rotatable extracting cylinder (A) and transferred to a first rotating opening cylinder (B) and a second rotating opening cylinder (C) which open the gripped signatures (1) at the edges (4, 5) opposite from the fold (3) and drop the signatures onto the transport device (6). To open and transport the signatures (1) onward, the signatures (1) are gripped at their respective protruding edge (5) by a clamping device (48) disposed on the first opening cylinder (B). Projections are provided which catch behind the above-referenced edges (4, 5) in the extracting cylinder (A) and transfer the edges to the clamping device (48). These projections include a guide arm (7) which is movably supported on the first opening cylinder (B) and moves in response to a rotation of the first opening cylinder (B) from a retracted position into a position projecting over the circumference (27) of the first opening cylinder (B). This arrangement restrictedly guides the signatures and reliably transfers the signatures to the opening drum (B, C) even at high velocities.

10 Claims, 4 Drawing Sheets

APPARATUS FOR PLACING FOLDED SIGNATURES ON A TRANSPORT DEVICE

BACKGROUND OF THE INVENTION

1. Field of the Invention

The present invention relates to an apparatus for depositing folded signatures on a transport device, with a rotating extracting cylinder which grips signatures individually from a stack and transfer the signatures to a first rotating opening cylinder and a second rotating opening cylinder which open the gripped signatures at the edges opposite from the fold and drop the signatures on the transport device, with a clamping device disposed on the first opening cylinder which grips the signatures at a respective projecting edge to open and transport the signatures, and with means which grip the above-referenced edges in the extracting cylinder from behind and transfer the edges to the clamping device.

2. Description of the Related Art

An apparatus of this type is disclosed in CH-A-408 065 by the applicant. The first opening cylinder includes a cylinder sector which has a greater radius than the remaining cylinder sector of the opening cylinder and which engages in the rotation range of the extracting cylinder. The cylinder sector also grips the rear end of a signature from behind and grips a protruding edge with a clamping device. The signature is subsequently opened in cooperation with the second opening cylinder and drop to on a transport device which may be implemented as a collecting chain. Such devices have operated satisfactorily in practice. The cylinder sector with the greater radius, however, occupies a comparatively greater portion of the circumference of the extracting cylinder which makes this device less efficient.

A similar device is disclosed in JP-A-0 42 69 594. The extracting cylinders and the two opening cylinders or hear driven by dedicated synchronous motors. The rotation speed of the towns can be adjusted with a controller. The signature is gripped by a cylinder sector of the first opening cylinder. This design decreases the problems associated with the intermeshing cylinders.

U.S. Pat. No. 4,875,669 describes a device which includes three rotatable arms arranged on the extracting cylinder up which push the rear edges the signature radially outwardly for transfer to the opening cylinders. With this device, several signatures can be transported simultaneously on the extracting cylinder. The extracting cylinder, however, also includes control arms and is therefore expensive to fabricate and subject to malfunction. In addition, the clamping device on the first opening cylinder makes the arms more difficult to synchronize.

SUMMARY OF THE INVENTION

It is therefore an object of the invention, to provide a device of the type described above which has a greater efficiency and reliability and can be manufactured more cost-effectively. This object is solved by the invention in that the aforedescribed means include at least one guide arm which is movably supported on the first opening cylinder, wherein when the first opening cylinder rotates, the guide arm is moved from a retracted position into a position projecting over the circumference of the first opening cylinder, so that the guide arm can grip the edges of the signatures from behind.

The device of the invention, like the device disclosed in CH-A-408 065, eliminates the need for a large cylinder sector. The signatures can therefore be transported on the extracting cylinder with a closer spacing, thereby advantageously reducing the transport speed. Other means for gripping the signatures from behind can also be provided. Arranging a guide arm on the first opening cylinder has the advantage that the signatures are guided at their respective rear ends when they are transferred to the clamping device. Gravity has almost no effect on the process, and breakdown are less frequent even at peak capacity.

According to another embodiment of the invention, the guide arm is rotatably supported on the first opening cylinder, but spaced apart from the axis of the first opening cylinder. The guide arm can then be easily retracted in the first opening cylinder by rotating the guide arm.

According to another embodiment of the invention, the guide arm is rotated rearward to move the guide arm into the retracted position and rotated forward—as viewed in the rotation direction—for gripping a signature. This rotation causes the guide arm to engage with the rotation region of the extracting cylinder and to grip the rear portion of a signature which is thereby deflected radially outwardly and transferred to the gripping device. The guide arm can be retracted again by rotating the guide arm in the opposite direction. According to another embodiment of the invention, the guide arm may be movably supported on a shaft which makes it easy to adapt the device quickly to different signature formats.

The signatures can be transferred reliably to the first opening cylinder by disposing a rotating defection roller between the two cylinders. The signature is here placed in contact with the deflection roller after the edges have been gripped.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, An embodiment of the invention is described in detail hereinafter with reference to the drawing.

DETAILED DESCRIPTION OF THE PRESENTLY PREFERRED EMBODIMENTS

Figure 1:
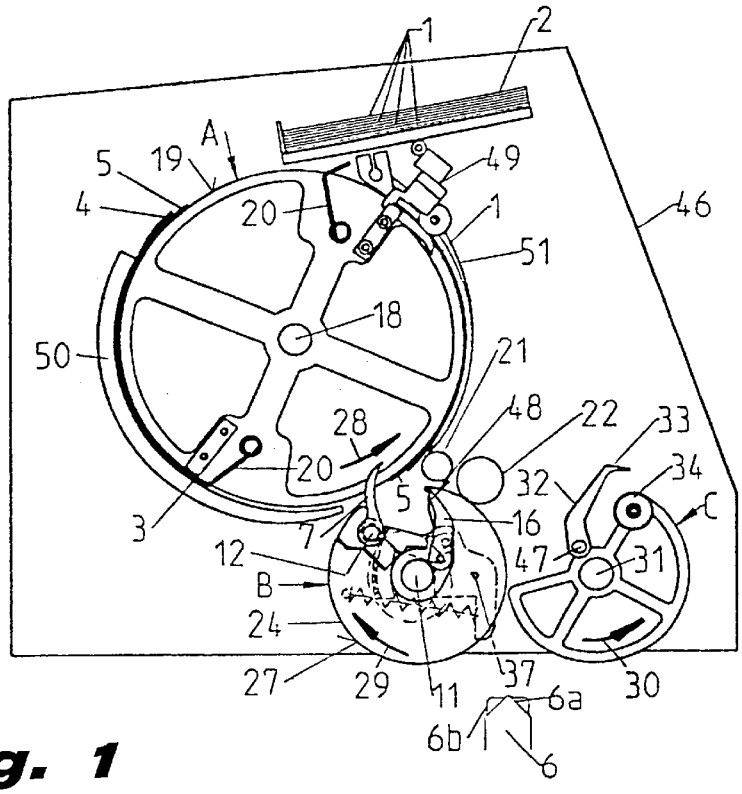
FIG. 1 shows a partial view of the apparatus of the invention.

FIG. 1 shows one of two spaced apart support plates 46, on which are rotatably supported an extracting cylinder A, a first opening cylinder B and a second opening cylinder C. The arrows 28, 29 and 30 indicate the rotation direction of the three cylinders A to C. The drive mechanism for these cylinders is conventional and will therefore not be described in detail. The device is, for example, a part of a collating stapler adapted to place signatures 1 from a stack 2 individually on a transport device 6. This transport device 6 is not explicitly shown and may be, for example, a conventional collecting chain with saddle-shaped supports 6*a* and drivers 6*b*.

Each of the signatures 1 has a fold 3 and opposing edges 4 and 5, with one of the edges 5 protruding. A gripper 49 of conventional design grips the bottom signature of the stack 2 from the stack 2, for example using vacuum suction, and a rotatable clamping lever 20 attached the fold 3 of the signature 1 to the extracting cylinder. The signature 1 is placed against the extracting cylinder A, as illustrated in FIG. 1, and rotates with the extracting cylinder A in the direction of the arrow 28. Guide cylinder segments 50 and 51 prevent the gripped signature from lifting off the rotating extracting cylinder A. As also shown in FIG. 1, two opposing clamping levers 20, each adapted to clamp one signature 1, are arranged on the extracting cylinder A which rotates about the axis 18. The extracting cylinder A is thus capable off transporting two signatures 1 simultaneously.

The first opening cylinder B rotates about the axis 11 in the direction of the arrow 29 and includes a clamping device 48 which rotates with the first opening cylinder B. The clamping device 48 essentially consists of a clamping jaw 40 with a clamping surface 41 (FIG. 6) and a rotatable lever 16. The clamping jaw 40 cooperates with the clamping lever 16 to grip the protruding edge 5 of a signature 1, whereby the signature is pulled off the extracting cylinder A and opened and dropped on the transport device 6. The clamping lever 20 releases the respective signature 1 before the rotatable lever 16 grips the protruding edge 5.

Figure 2:
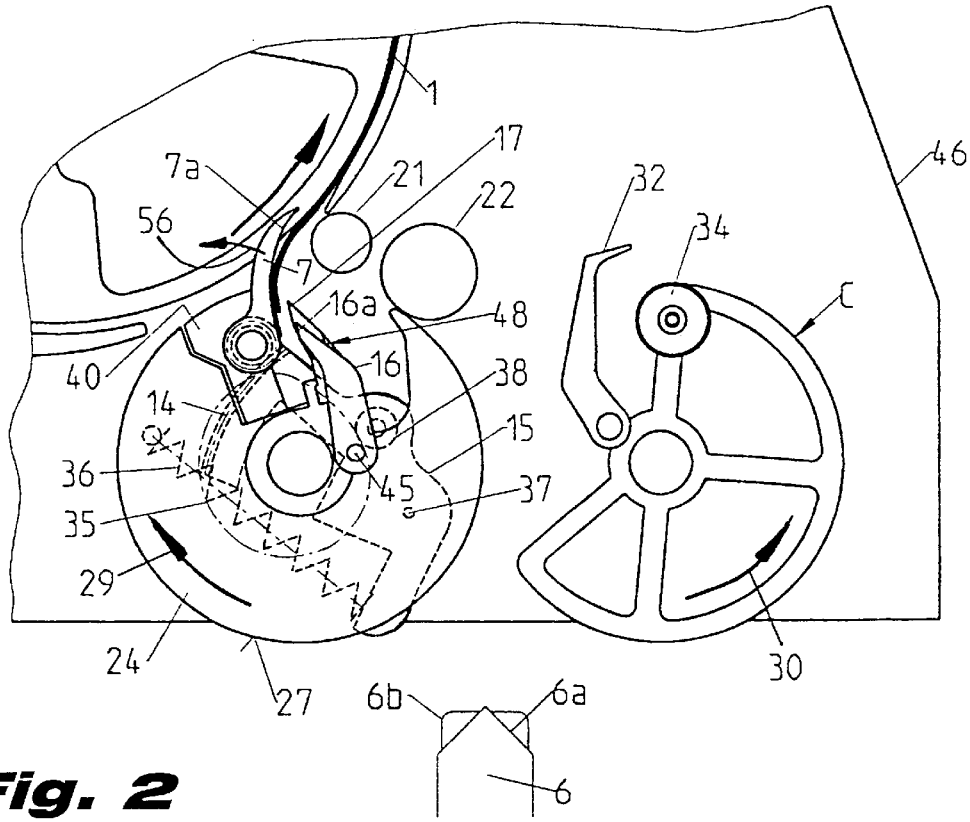
FIGS. 2 to 5 show additional partial views of the apparatus of the invention in temporally sequential positions of the individual elements.
Figure 3:
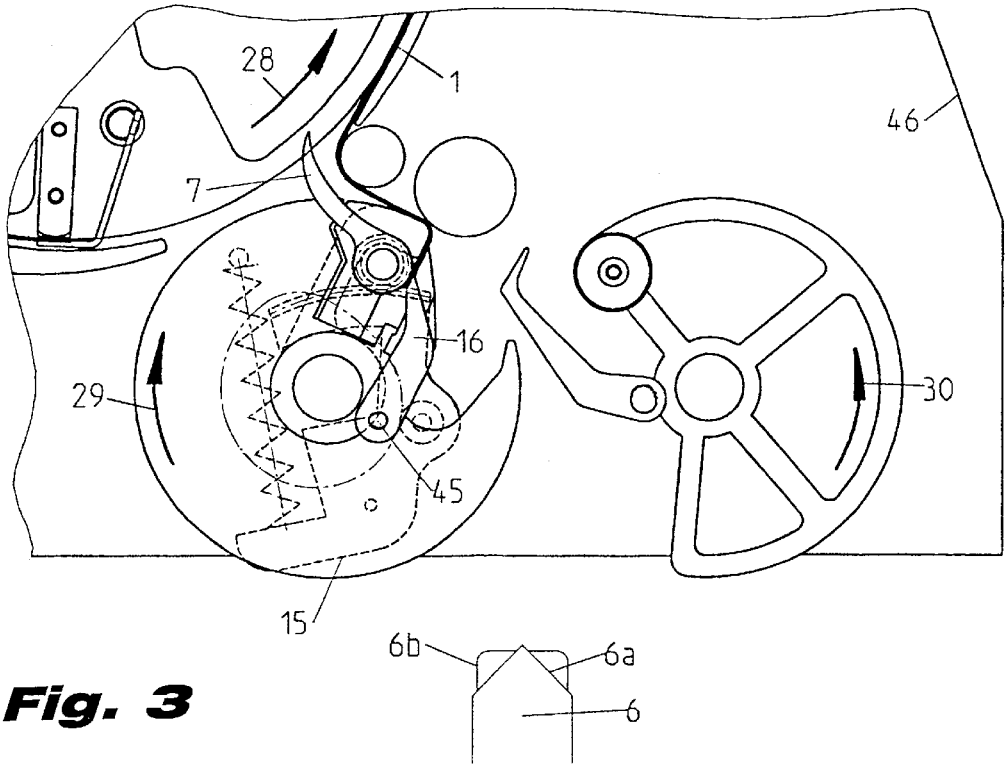
Figure 4:
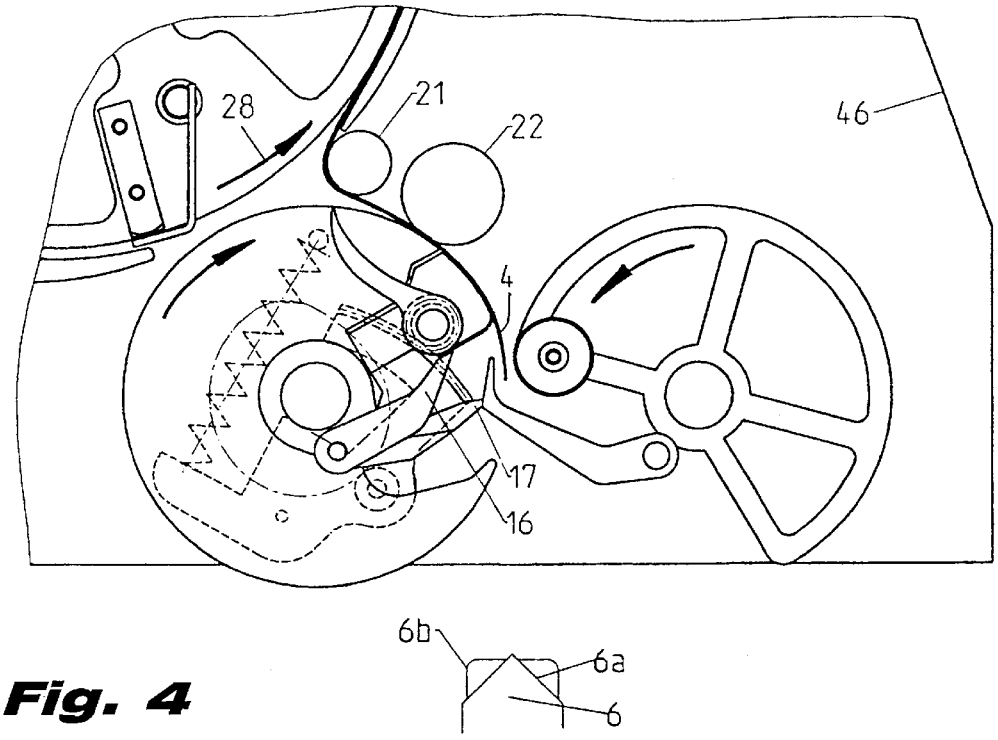
Figure 5:
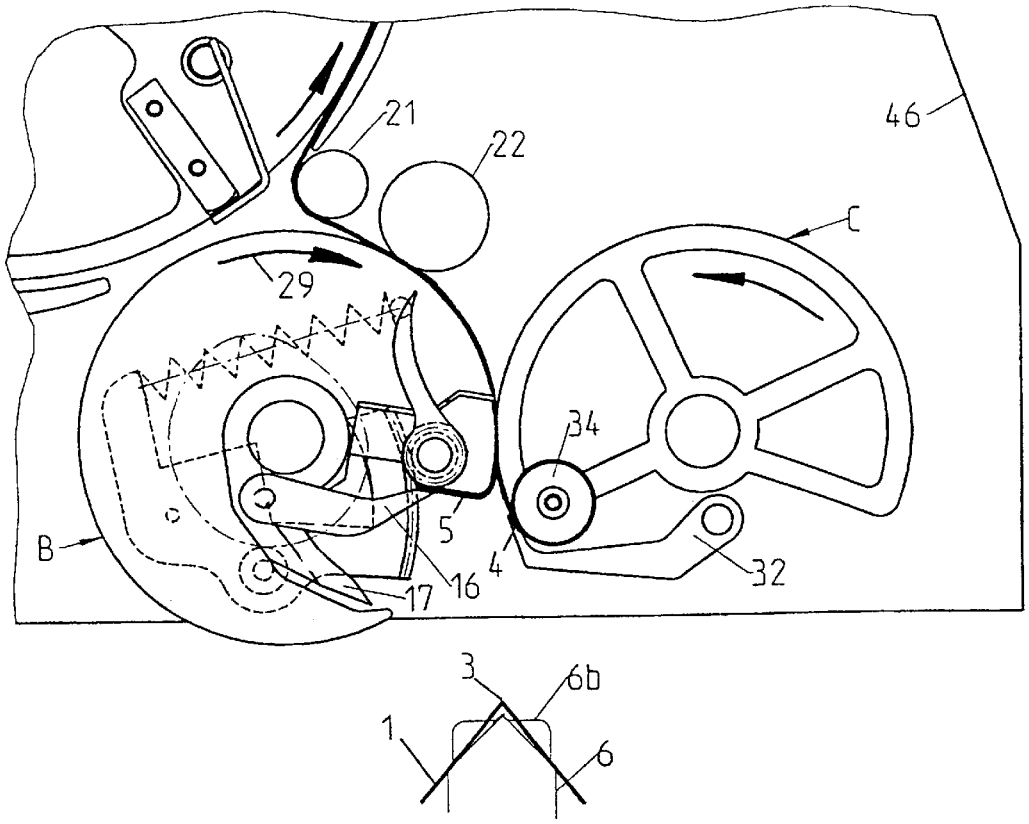

Several guide arms 7 are supported on a shaft 12 on the first opening cylinder B so that the two edges 4 and 5 of a signature 1 can be gripped. According to FIG. 6, the spacedapart two guide arms 7 are secured non-rotatably to the keyed shaft 12, for example, with clamping screws 53. The guide arms 7 can move along the shaft 12 by releasing the clamping screws 53, so that the apparatus can be easily and quickly adapted to different signature formats. The ends of the shaft 12 are rotatably supported on disks 54, with only one of the disks shown in FIG. 6. The disks 54 are non-rotatably connected with the axis 11. A pinion 13 which meshes with a toothed segment 14 of a two-armed control lever 15, is attached to at least one end of the shaft 12. The control lever 15 is seated on the disk 54 and can be rotated about an axis 37 over a limited range. A roller 38 is the arranged on the control lever 15 and offset from the axis 37. The roller 38 is biased against a stationery cam disk 45 by a spring 36. When the first opening cylinder B rotates, the two-armed control lever 15 also rotates, and the guide arms 7 rotate accordingly when the toothed segment 14 engages the pinion 13. In a first position, the guide arms 7 extend approximately radially from the axis 11, as illustrated in FIG. 2. The guide arms 7 project with a free end 7*a* over of the circumference 27 of the first opening cylinder B and move into engagement with the extracting cylinder A between the two segments 50 and 51. FIG. 2 illustrates the situation where the pinion 13 is located at one end of the toothed segment 14. When the first opening cylinder B continues to rotate, the arms 7 rotate backward in the direction of the arrow which indicates the rotation direction, and assume a position in which the arms 7 do no longer project over the circumference 27 of a disk 24, as illustrated in FIGS. 4 and 5. The arms 7 finally rotate again in the opposite direction to assume—after a rotation of 360°—the position indicated in FIG. 2.

The rotation of the first opening cylinder B is synchronized with the rotation of the extracting cylinder A. This applies also to the aforedescribed rotation of the arms 7. As illustrated in FIG. 1, the rotation of the arms 7 is controlled so that the arms 7 engage with the extracting cylinder A so as to grip behind the rear edges 4 and 5 of a preceding signature 1. As seen in FIG. 2, the arms 7 guide the signature 1 outwardly with a concave guide surface 10 (FIG. 6) and convey the signature 1 to the clamping device 48 which grips the projecting edge 5 and thereby also the signature 1.

Figure 6:
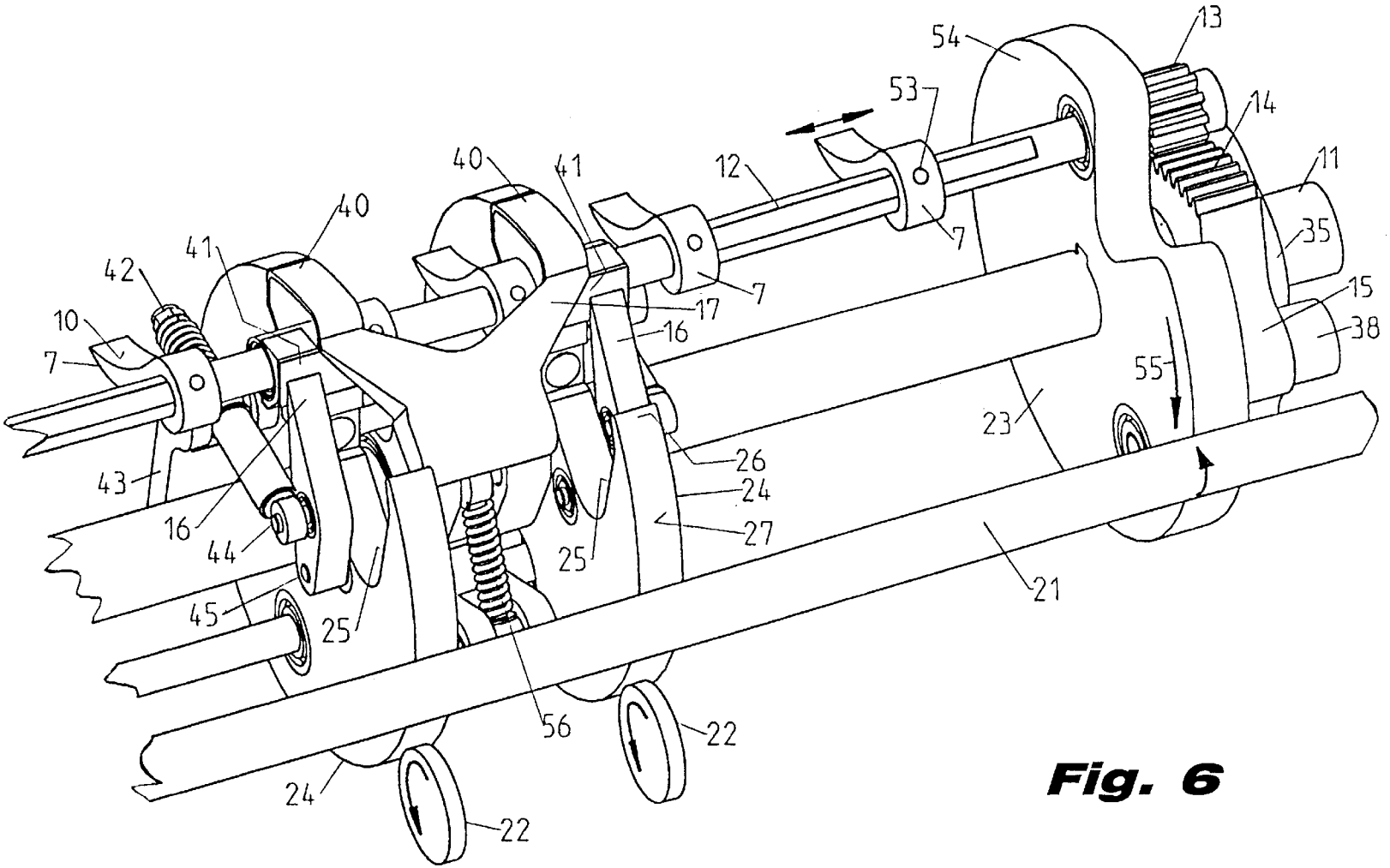
FIG. 6 shows schematically a perspective partial view of the apparatus of the invention.

As also seen in FIG. 6, the clamping device 48 includes two clamping jaws 40. Each of the camping jaws 40 is secured to a disk 24 which rotates with the jaws 40. Each of the clamping jaws 40 has a clamping surface 41, against which surface the gripper or clamping lever 16 can be pressed with a spring 42. For processing smaller formats, guide arms 7 can be arranged on the opening cylinder B between the inner disks 24. Each of the clamping levers 16 is supported on a respective axis 45, which is secured to a respective one of the disks 24, and can be rotated by a control cam (not shown). In the rotated position illustrated in FIG. 2, the respective free front ends 16*a* of the two levers 16 are spaced apart from the respective clamping surface 41 so that the edges 4 and 5 can be moved by the guide arms 7 into the position illustrated in FIG. 2. When the first opening cylinder B continues to rotate, the levers 16 are rotated against the shaft 12, thereby gripping and clamping the protruding edge 5. The range over which the two levers 16 and 17 can rotate, substantially matches a recess 25 (see FIG. 6) of the respective disk 24 which has a projection 26 that tangentially extends into the recess 25, as also seen in FIG. 6. To prevent the edges 4 and 5 from dropping behind the levers 16, 17, a projection 26 is provided which—as shown in FIG. 6—is located above the two levers 16, 17. The projection 26 protrudes slightly over the two levers 16, 17. The lever 17 is driven by a cam (not shown) and biased by a spring 56. As illustrated, for example, in FIG. 1, the lever 17 is rotatably supported on the axis 11. After the edge 5 is clamped, the lever 17 is rotated back to the position illustrated in the FIGS. 4 and 5. Since the levers 16 only clamp the edge 5 to the first opening cylinder B, the other edge remains free after the edge 5 is clamped. In the position illustrated in FIG. 4, the other edge is positioned distal from the edge 5 and is subsequently gripped between a rotatable lever 32 and a clamping roller 34 of the second opening cylinder C. When the two opening cylinders B and C continue to rotate further, the gripped signature 1 is opened and pulled downwardly out off the extracting cylinder A. The two edges 4 and 5 are then released by rotating the levers 16 and 32 accordingly. The open signature is dropped on the transport device 6, grasped by the drivers 6*b* and transported in the direction of the longitudinal fold 3 to another processing station, for example a collating stapler.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for placing folded signatures having edges on a transport device, comprising a rotating extracting cylinder (A) suitable of griping signatures (1) individually from a stack (2) and transferring the signatures to a first rotating opening cylinder (B);

a second rotating opening cylinder (C) for opening the gripped signatures (1) at the edges (4, 5) opposite from the fold (3) and dropping the signatures on the transport device (6), a clamp (48) disposed on the first rotating opening cylinder (B) for gripping the signatures (1) for opening and transport at one of the respective projecting edges (5), and means for gripping the edges (4, 5) in the extracting cylinder (A) from behind and transfer the edges to the clamp (48), wherein said means for gripping the edges (4,5) include at least one guide arm (7) which is movably supported on the first opening cylinder, and wherein the movement of the guide arm 7 is in response to a rotation of the first opening cylinder, and extends from a retracted position into a position projecting over the circumference of the first opening cylinder so that the gripping the edges is accomplished from behind the signatures.

2. The apparatus according to claim 1, wherein the movement of the guide arm (7) is a rotatably movement and the guide arm (7) is supported on the first opening cylinder (B) spaced apart from the rotation axis (11) of the first opening cylinder (B).

3. The apparatus according to claim 2, wherein the guide arm (7) comprises a free end **(7*a*)**, which is rotated backwards against the direction of rotation of the first opening cylinder (B) into the retracted position.

4. The apparatus according to claim 3, wherein the guide arm (7) comprises an arcuate convex guide surface (10), and which guide surface the gripped edges (4, 5) are guided for transfer to the clamping device (48).

5. The apparatus according to claim 4, wherein the guide arm (7) is movably supported on a shaft (12) for adaptation to different paper formats.

6. The apparatus according to claim 5, wherein the shaft (12) for rotating the guide arm (7) includes a pinion (13) which engages a toothed segment (14) of a rotatable control lever (15).

7. The apparatus according to claim 6, wherein at least one lever (16) is supported on the first opening cylinder (B), said lever temporarily clamps on the first opening cylinder (B) the protruding edge (5) of a signature (1) to open the signature (1).

8. The apparatus according to claim 7, wherein a projection (26) is provided on the first opening cylinder (B), which projection prevents the edges (4, 5) from dropping behind the levers (16, 17) provided for clamping the edges.

9. The apparatus according to claim 8, wherein for processing small formats, narrow guide arms (7) are disposed on the first opening cylinder (B) between two adjacent disks (24).

10. The apparatus according to claim 8, wherein at least two signatures (1) are transported consecutively on the extracting cylinder (A) and that the first opening cylinder (B) is controlled in such a way that the signatures are guided consecutively on the circumference of the opening cylinder (B) by at least two guide arms (7).

* * * * *